US011377956B2

(12) United States Patent
Schröder et al.

(10) Patent No.: US 11,377,956 B2
(45) Date of Patent: Jul. 5, 2022

(54) COVER PLATE WITH FLOW INDUCER AND METHOD FOR COOLING TURBINE BLADES

(71) Applicant: Siemens Energy Global GmbH & Co. KG, Munich (DE)

(72) Inventors: Peter Schröder, Essen (DE); Christopher W. Ross, Oviedo, FL (US); Santiago R. Salazar, Charlotte, NC (US); Patrick M. Pilapil, Kissimmee, FL (US); Roger Matthews, Greer, SC (US); Kevin Kampka, Mülheim a. d. Ruhr (DE); Joana Verheyen, Nettetal (DE); Ching-Pang Lee, Cincinnati, OH (US); Javan Albright, Mason, OH (US); James McCoy, Taylor Mill, KY (US); Sin Chien Siw, Oviedo, FL (US); Kok-Mun Tham, Oviedo, FL (US)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 0 days.

(21) Appl. No.: 17/261,712

(22) PCT Filed: Jul. 23, 2018

(86) PCT No.: PCT/US2018/043286
§ 371 (c)(1),
(2) Date: Jan. 20, 2021

(87) PCT Pub. No.: WO2020/023005
PCT Pub. Date: Jan. 30, 2020

(65) Prior Publication Data
US 2021/0301664 A1 Sep. 30, 2021

(51) Int. Cl.
*F01D 5/08* (2006.01)
*F01D 5/30* (2006.01)

(52) U.S. Cl.
CPC ..... *F01D 5/082* (2013.01); *F01D 5/3015* (2013.01); *F05D 2220/32* (2013.01); *F05D 2220/3215* (2013.01); *F05D 2260/20* (2013.01)

(58) Field of Classification Search
CPC ..... F01D 5/081; F01D 5/082; F01D 5/186; F01D 5/187; F01D 5/3015; F01D 5/3069;
(Continued)

(56) References Cited

U.S. PATENT DOCUMENTS 3,137,478 A 6/1964 Farrell
6,065,932 A 5/2000 Dodd
(Continued)

FOREIGN PATENT DOCUMENTS

EP 3121372 A1 1/2017
JP S61205303 A 9/1986
(Continued)

OTHER PUBLICATIONS

PCT International Search Report and Written Opinion of International Searching Authority dated Sep. 28, 2018 corresponding to PCT International Application No. PCT/US2018/043286 filed Jul. 23, 2018.

*Primary Examiner* — Christopher Verdier

(57) ABSTRACT

A flow inducer assembly and a method for cooling turbine blades of a gas turbine engine are presented. The gas turbine engine includes a rotor disk having circumferentially distributed disk grooves and turbine blades. Each turbine blade includes a blade root inserted into blade mounting section of the disk groove. Seal plates are attached to an aft side circumference of the rotor disk. The flow inducer assembly is integrated to each seal plate at a side facing away from the
(Continued)

rotor disk. The flow inducer assembly is configured to function as a paddle due to rotation of the rotor disk and the seal plate therewith during operation of the gas turbine engine to drive ambient air as a cooling fluid into the disk cavity and enter inside of the turbine blade from the blade root for cooling the turbine blade.

9 Claims, 4 Drawing Sheets

(58) Field of Classification Search
CPC ..... F05D 2260/20; F05D 2260/202; F05D 2220/3215
See application file for complete search history.

(56) References Cited

U.S. PATENT DOCUMENTS

| | | | | |
|---|---|---|---|---|
| 7,677,048 | B1 | 3/2010 | Brostmeyer et al. | |
| 8,657,577 | B2 | 2/2014 | Martin et al. | |
| 2006/0120855 | A1 | 6/2006 | Djeridane et al. | |
| 2006/0188377 | A1* | 8/2006 | Dixon ..... | F01D 5/081 416/221 |
| 2007/0217904 | A1 | 9/2007 | Dixon et al. | |
| 2015/0252688 | A1 | 9/2015 | Marsh et al. | |
| 2017/0022818 | A1 | 1/2017 | Weinert et al. | |

FOREIGN PATENT DOCUMENTS

| | | | |
|---|---|---|---|
| JP | 2012510580 | A | 5/2012 |
| JP | 2017518452 | A | 7/2017 |

* cited by examiner

COVER PLATE WITH FLOW INDUCER AND METHOD FOR COOLING TURBINE BLADES

FIELD OF THE INVENTION

This invention relates generally to a flow inducer assembly and a method for cooling turbine blades of a gas turbine engine, in particular, the last stage turbine blades of the gas turbine engine, using ambient air.

DESCRIPTION OF RELATED ART

An industrial gas turbine engine typically includes a compressor for compressing air, a combustor for mixing the compressed air with fuel and igniting the mixture, a turbine section for producing mechanical power, and a generator for converting the mechanical power to an electrical power. The turbine section includes a plurality of turbine blades that are attached on a rotor disk. The turbine blades are arranged in rows axially spaced apart along the rotor disk and circumferentially attached to a periphery of the rotor disk. The turbine blades are driven by the ignited hot gas from the combustor and are cooled using a coolant, such as a cooling fluid, through cooling passages in the turbine blades.

Typically, cooling fluid may be supplied by bleeding compressor air. However, bleeding air from the compressor may reduce turbine engine efficiency. Due to high operation pressures of the first, second and third stage turbine blades, bleeding compressor air may be required for cooling the first, second and third stage turbine blades. The last stage turbine blades operate under the lowest pressure, ambient air may be used for cooling the last stage turbine blades. In order to sufficiently cool the last stage turbine blades to achieve required boundary conditions, an efficient flow inducer system is needed to bring sufficient amount of the ambient air into cooling passages of the last stage turbine blade. There is a need to provide an easy and simple system to capture sufficient amount of ambient air into the cooling passages of the last stage turbine blade for sufficiently cooling the last stage turbine blades.

SUMMARY OF THE INVENTION

Briefly described, aspects of the present invention relate to a gas turbine engine, a seal plate configured to be attached to a rotor disk of a gas turbine engine, and a method for cooling turbine blades of a gas turbine engine.

According to an aspect, a gas turbine engine is presented. The gas turbine engine comprises a rotor disk comprising a plurality of circumferentially distributed disk grooves. Each disk groove comprises a blade mounting section and a disk cavity. The gas turbine engine comprises a plurality of turbine blades. Each turbine blade comprises a blade root that is inserted into the blade mounting section of the disk groove. The gas turbine engine comprises a plurality of seal plates attached to an aft side circumference of the rotor disk. Each seal plate comprises an upper seal plate wall and a lower seal plate wall. The upper seal plate wall is configured to cover the blade root. The gas turbine engine comprises a plurality of flow inducer assemblies. Each flow inducer assembly is integrated to each seal plate at a side facing away from the rotor disk. The flow inducer assembly is configured to function as a paddle due to rotation of the rotor disk and the seal plate therewith during operation of the gas turbine engine to drive a cooling fluid into the disk cavity and enter inside of the turbine blade from the blade root for cooling the turbine blade.

According to an aspect, a seal plate configured to be attached to a rotor disk of a gas turbine engine is presented. The gas turbine engine comprises a rotor disk comprising a plurality of circumferentially distributed disk grooves. Each disk groove comprises a blade mounting section and a disk cavity. Each turbine blade comprises a blade root that is inserted into the blade mounting section of the disk groove. The seal plate is attached to an aft side of the rotor disk. The seal plate comprises an upper seal plate wall configured to cover the blade root. The seal plate comprises a lower seal plate wall. The seal plate comprises a flow inducer assembly integrated to the seal plate at a side facing away from the rotor disk. The flow inducer assembly is configured to function as a paddle due to rotation of the rotor disk and the seal plate therewith during operation of the gas turbine engine to drive a cooling fluid into the disk cavity and enter inside of the turbine blade from the blade root for cooling the turbine blade According to an aspect, a method cooling turbine blades of a gas turbine engine is presented. The gas turbine engine comprises a rotor disk comprising a plurality of circumferentially distributed disk grooves. Each disk groove comprises a blade mounting section and a disk cavity. Each turbine blade comprises a blade root that is inserted into the blade mounting section of the disk groove. The method comprises attaching a plurality of seal plates to aft side circumference of the rotor disk. Each seal plate comprises an upper seal plate wall and a lower seal plate wall. The upper seal plate wall is configured to cover the blade root. The method comprises attaching a plurality of flow inducer assemblies to the seal plates. Each flow inducer assembly is integrated to each seal plate at a side facing away from the rotor disk. The flow inducer assembly is configured to function as a paddle due to rotation of the rotor disk and the seal plate therewith during operation of the gas turbine engine to drive a cooling fluid into the disk cavity and enter inside of the turbine blade from blade root for cooling the turbine blade.

Various aspects and embodiments of the application as described above and hereinafter may not only be used in the combinations explicitly described, but also in other combinations. Modifications will occur to the skilled person upon reading and understanding of the description.

BRIEF DESCRIPTION OF THE DRAWINGS

Exemplary embodiments of the application are explained in further detail with respect to the accompanying drawings. In the drawings.

To facilitate understanding, identical reference numerals have been used, where possible, to designate identical elements that are common to the figures.

DETAILED DESCRIPTION OF THE INVENTION

A detailed description related to aspects of the present invention is described hereafter with respect to the accompanying figures.

Figure 1:
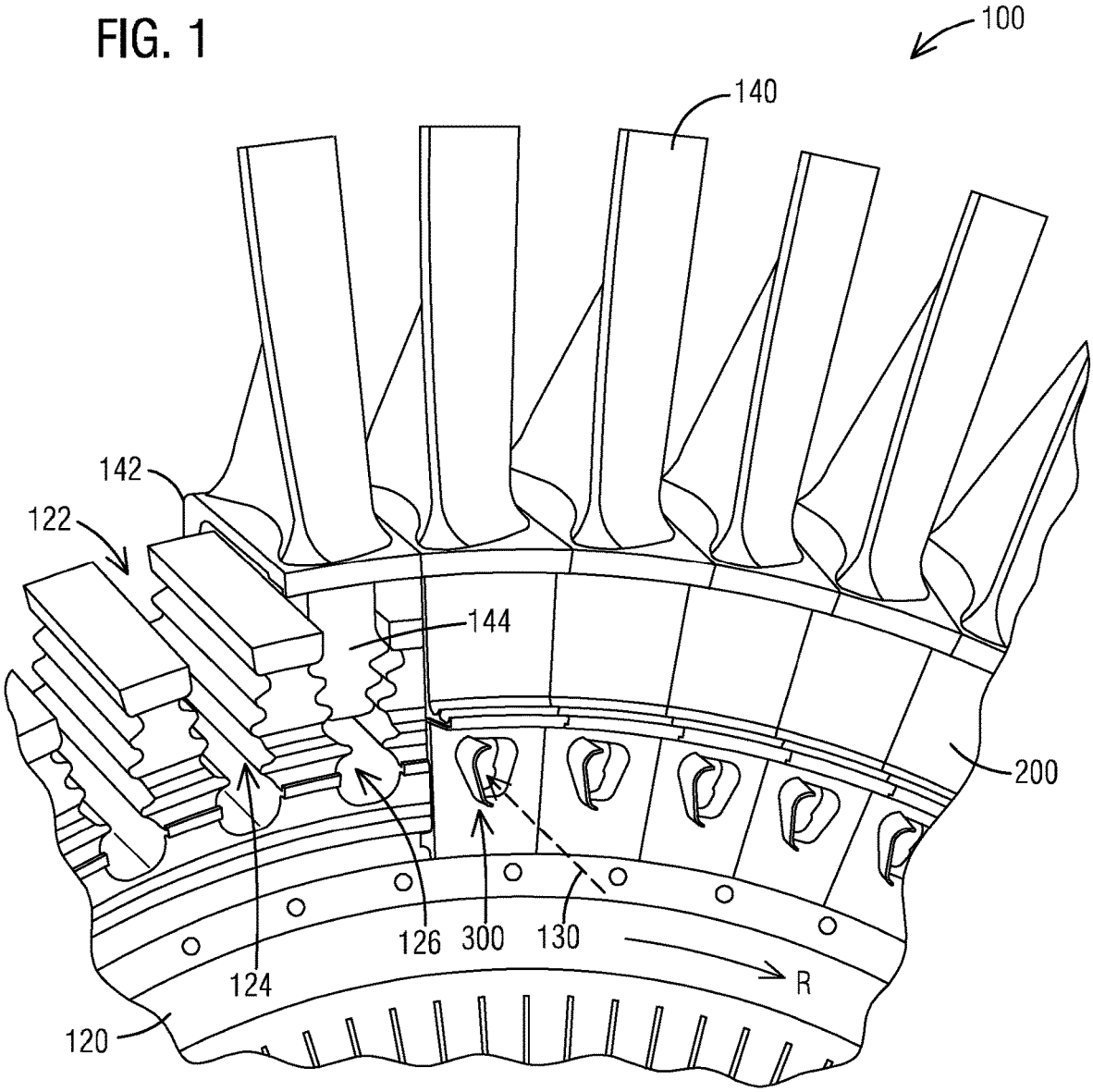
FIG. 1 illustrates a schematic perspective view of a portion of a gas turbine engine showing the last stage, in which embodiments of the present invention may be incorporated.

FIG. 1 illustrates a schematic perspective view of a portion of a gas turbine engine 100 showing the last stage looking in an aft side with respect to an axial flow direction. The gas turbine engine 100 includes a flow inducer assembly 300 according to embodiments of the present invention. As illustrated in FIG. 1, the gas turbine engine 100 includes a last stage rotor disk 120 and a plurality of last stage turbine blades 140 that are attached along an outer circumference of the rotor disk 120. A plurality of seal plates 200 are attached to the aft side circumference of the last stage rotor disk 120. The seal plate 200 may prevent hot gas coming into the aft side of the rotor disk 120. The seal plates 200 are secured to the rotor disk 120. The rotor disk 120 may rotate in a direction as indicated by the arrow R during operation of the gas turbine engine 100, which rotates the turbine blades 140 and the seal plates 200 therewith in the same direction R. For clarity purpose, one turbine blade 140 and one seal plate 200 are removed from the rotor disk 120.

With reference to FIG. 1, the rotor disk 120 includes a plurality of disk grooves 122. Each disk groove 122 includes a blade mounting section 124 and a disk cavity 126. Each turbine blade 140 includes a platform 142 and a blade root 144 that extends radially downward from the platform 142. Each turbine blade 140 is attached to the rotor disk 120 by inserting the blade root 144 into the blade mounting section 124 of the rotor disk groove 122. The disk cavity 126 is formed between the blade root 144 and bottom of the disk groove 122. Each seal plate 200 includes an upper seal plate wall 220 and a lower seal plate wall 240. A seal arm 230 may extend axially outward between the upper seal plate wall 220 and the lower seal plate wall 240. The upper seal plate wall 220 covers the blade root 144. A flow inducer assembly 300 is attached to the lower seal plate wall 240. The flow inducer assembly 300 aligns with the disk cavity 126 of the disk groove 122.

During engine operation, rotation of the last stage turbine blades 140 creates a pumping force to drive cooling fluid into the disk cavity 126 of the disk groove 120 as indicated by the cooling flow arrow 130 due to a centrifugal force. The cooling fluid enters inside of the turbine blade 140 from the blade root 144 for cooling the turbine blade 140 and exits through openings in the turbine blade 140 to a gas path of the gas turbine engine 100. The cooling fluid may be ambient air. According to embodiments of the present invention, the flow inducer assembly 300 arranged on the seal plate 200 provides further driving force to induce ambient air entering the disk cavity 126 for sufficiently cooling the last stage turbine blade 140. The flow inducer assembly 300 and the seal plate 200 may be manufactured as an integrated single piece.

FIGS. 2 to 7 illustrate schematic perspective views of a seal plate 200 having an integrated flow inducer assembly 300 according to various embodiments of the present invention.

Figure 2:
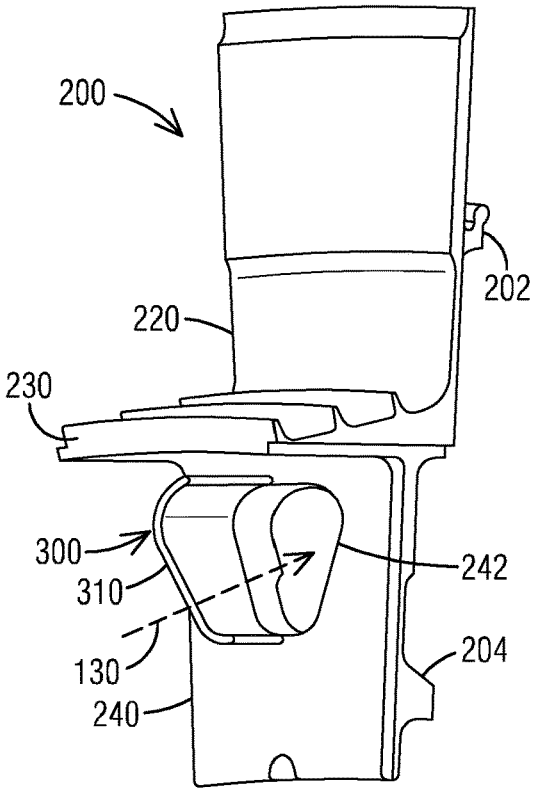
FIGS. 2 to 7 illustrate schematic perspective views of flow inducer assemblies according to various embodiments of the present invention.

FIG. 2 illustrates a schematic perspective view of a seal plate 200 having an integrated flow inducer assembly 300 according to an embodiment of the present invention. As shown in FIG. 2, the seal plate 200 includes an upper seal plate wall 220 and a lower seal plate wall 240. A seal arm 230 extends axially outward between the upper seal plate wall 220 and the lower seal plate wall 240. The seal plate 200 may have a hook 202 displaced at a side of the upper seal plate wall 220 facing to the rotor disk 120. The hook 202 may have a U-shape that attaches to the rotor disk 120. The seal plate 200 may have a protrusion 204 protruded from a side of the lower seal plate wall 240 facing to the rotor disk 120. The protrusion 204 may have a dovetail shape that attaches to the rotor disk 120. The hook 202 and the protrusion 204 secure the seal plate 200 to the rotor disk 120. The seal plate 200 has an aperture 242 axially penetrating through the lower seal plate wall 240. The aperture 242 may be located at the lower seal plate wall 240 with a radial distance below the seal arm 230. The aperture 242 may align with the disk cavity 126 of the disk groove 122 after assembly. The aperture 242 may generally have a similar shape with the disk cavity 126.

According to an exemplary embodiment as illustrated in FIG. 2, a flow inducer assembly 300 is integrated to the seal plate 200 at a side facing away from the rotor disk 120 and extends outward in an axial direction. The flow inducer assembly 300 may include a curved plate 310 attached radially along the aperture 242 at a downstream side with respect to the rotation direction R of the rotor disk 120 as shown in FIG. 1. The curved plate 310 may be blended with the aperture 242 in a tangential direction of the aperture 242. The curved plate 310 may have a similar curvature with the aperture 242. During operation of the gas turbine engine 100, rotation of the rotor disk 120 and the seal plate 200 therewith makes the curved plate 310 of the flow inducer assembly 300 function as a paddle that further induces cooling air 130, such as ambient air from outside of the gas turbine engine 100, in addition to cooling air 130 that is induced by a centrifugal force caused by rotation of the turbine blades 140, into the aperture 242 and the disk cavity 126 and enters insides of the turbine blades 140 from the blade roots 144 for cooling the turbine blades 140. The curved plate 310 may have a scoop shape.

Figure 3:
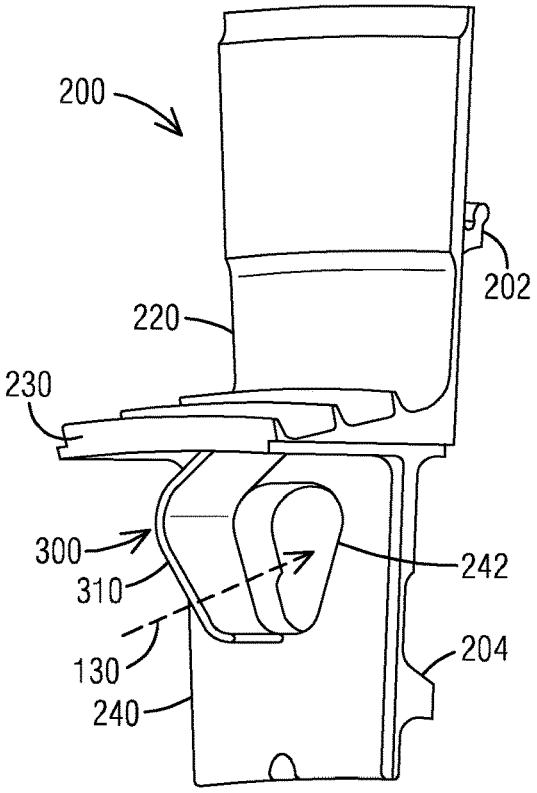

Dimensions of the flow inducer assembly 300 may be designed to achieve cooling requirement for sufficiently cooling the turbine blades 140. Dimensions of the flow inducer assembly may include a radial height of the curved plate 310, an axial length of the curved plate 310, etc. A radial height of the curved plate 310 may be less than, or equal to, or greater than a radial height of the aperture 242. For illustration purpose, FIG. 2 and FIG. 3 show the curved plates 310 having different radial heights. According to an exemplary embodiment as illustrated in FIG. 2, a radial height of the curved plate 310 is equal to a radial height of the aperture 242. As illustrated in FIG. 2, the curved plate 310 is attached along the aperture 242 at the downstream side starting from the lowest point of the aperture 242 and ending at the highest point of the aperture 242.

According to another exemplary embodiment as illustrated in FIG. 3, a radial height of the curved plate 310 is greater than a radial height of the aperture 242. As illustrated in FIG. 3, the curved plate 310 is attached along the aperture 242 at the downstream side starting from the lowest point of the aperture 242 and ending at the seal arm 230. Such embodiment may also improve mechanical properties of the flow inducer assembly 300, such as increasing mechanical strength, reducing vibration, etc. It is understood that the curved plate 310 may be attached along the aperture 242 at the downstream starting at a radial point that is below the lowest point of the aperture 242, or above the lowest point of the aperture 242. It is also understood that the curved plate 310 may be attached along the aperture 242 at the downstream side ending at a radial point that is below the highest point of the aperture 242, or between the highest point of the aperture 242 and the seal arm 230.

An axial length of the curved plate 310 may change along a radial direction. According to exemplary embodiments as illustrated in FIG. 2 and FIG. 3, the axial length of the curved plate 310 may be shorter in the lower portion and longer in the upper portion. For example, the maximum axial length of the curved plate 310 from the lower seal plate wall 240 may be located at the upper portion of the curved plate 310 that is near a region of the top of the curved plate 310.

Figure 4:
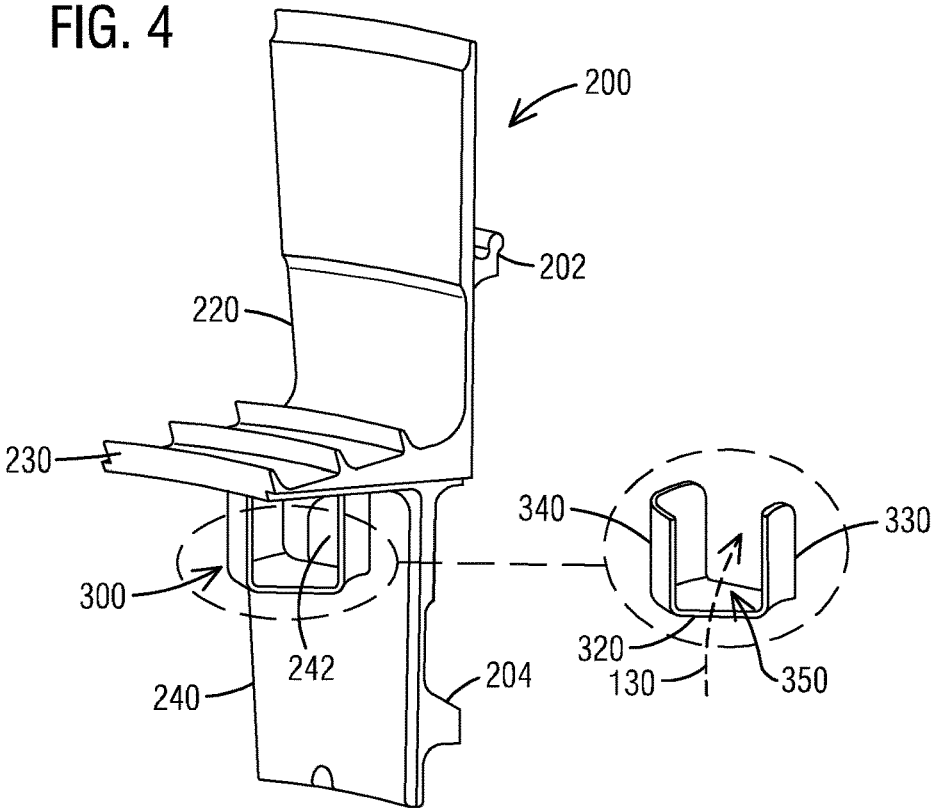

FIG. 4 illustrates a schematic perspective view of a seal plate 200 having an integrated flow inducer assembly 300 according to an embodiment of the present invention. The flow inducer assembly 300 viewing in a different perspective view direction is also illustrated in FIG. 4. As shown in FIG. 4, the flow inducer assembly 300 may include a floor plate 320 that is attached to the lower seal plate wall 240 and extends axially outward from the lower seal plate wall 240 at a radial location of the lowest point of the aperture 242. The floor plate 320 may be parallel to the seal arm 230 of the seal plate 200. The flow inducer assembly 300 may include an inner side wall 330 and an outer side wall 340 radially extending upward from the floor plate 320. The inner side wall 330 and the outer side wall 340 may be radially attached between the floor plate 320 and the seal arm 230. The inner side wall 330 and the outer side wall 340 are spaced apart from each other and attached at two circumferential sides of the aperture 242 forming a partial annular shape. The inner side wall 330 may be attached to the aperture 242 at the upstream side. The outer side wall 340 may be attached to the aperture 242 at the downstream side. The inner side wall 330 and the outer side wall 340 may be two curved plates. The arc length of the outer side wall 340 is longer than the arc length of the inner side wall 330 forming an inlet 350 facing to the rotation direction R of the rotor disk 120. During operation of the gas turbine engine 100, rotation of the rotor disk 120 and the seal plate 200 therewith makes the flow inducer assembly 300 function as a paddle that further induces cooling air 130, such as ambient air from outside of the gas turbine engine 100, in addition to cooling air 130 that is induced by a centrifugal force caused by rotation of the turbine blades 140, into the flow inducer assembly 300 through the inlet 350 and flows into the aperture 242 and the disk cavity 126 and enters insides of the turbine blades 140 from the blade roots 144 for cooling the turbine blades 140.

Figure 5:
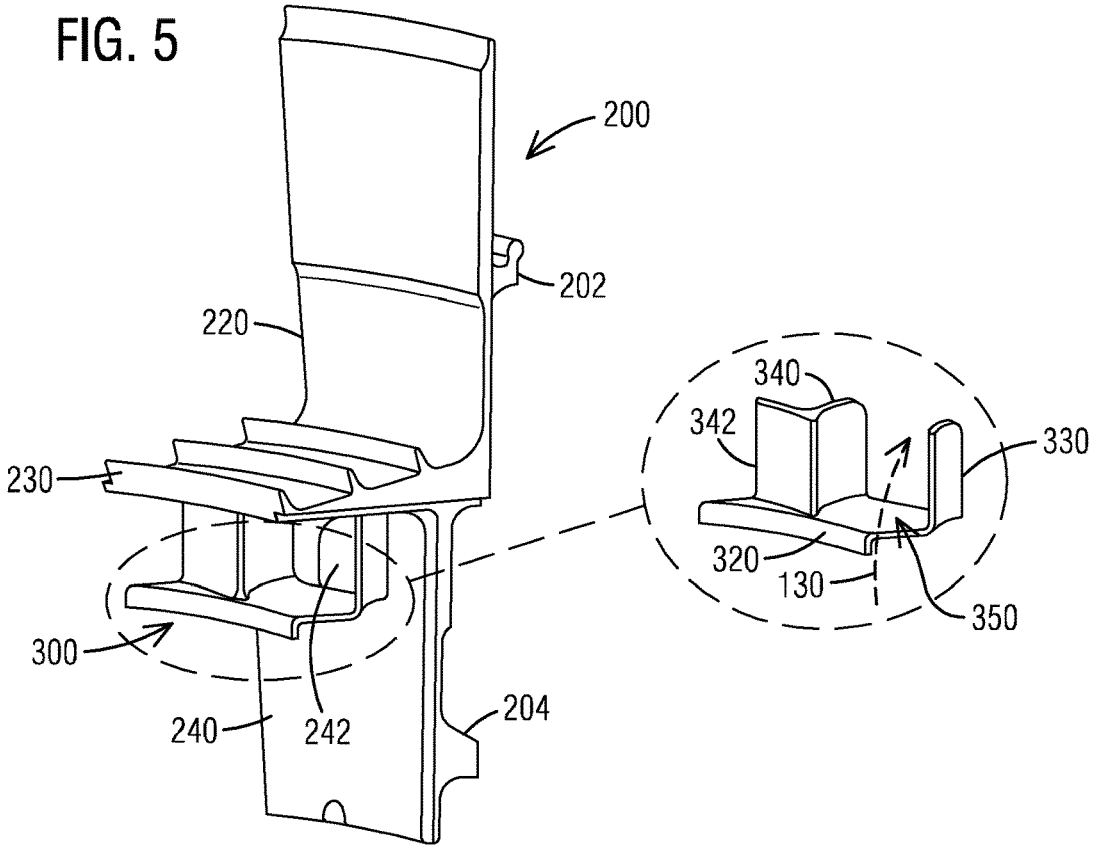

FIG. 5 illustrates a schematic perspective view of a seal plate 200 having an integrated flow inducer assembly 300 according to an embodiment of the present invention. The flow inducer assembly 300 viewing in a different perspective view direction is also illustrated in FIG. 5. As shown in FIG. 5, the floor plate 320 is laterally extended out the outer side wall 340. A vertical plate 342 is attached to the outer side wall 340 at the extended area of the floor plate 320 and radially extends upward from the floor plate 320. The vertical plate 342 may be attached between the floor plate 320 and the seal arm 230. The outer side wall 340 and the vertical plate 342 may be formed as a Y-shape. The configuration of the flow inducer assembly 300 as shown in FIG. 5 may improve mechanical properties of the flow inducer assembly 300, such as increasing mechanical strength, reducing vibration, etc.

Figure 6:
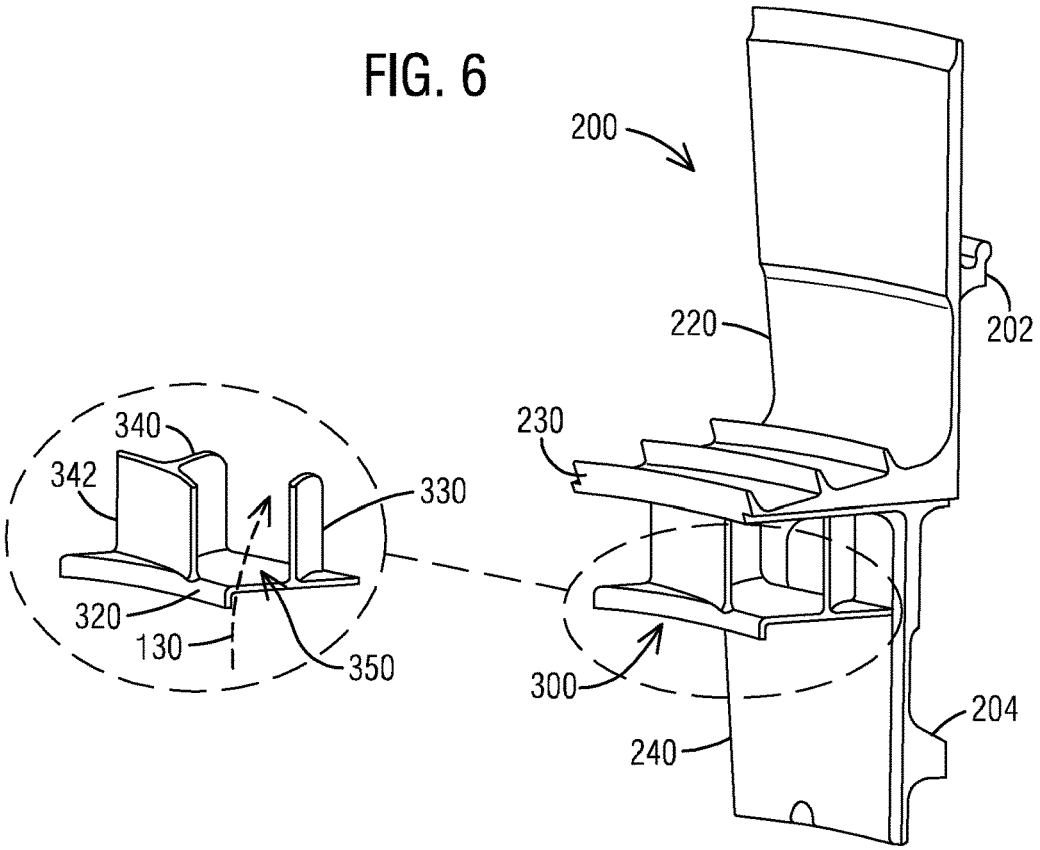

FIG. 6 illustrates a schematic perspective view of a seal plate 200 having an integrated flow inducer assembly 300 according to an embodiment of the present invention. The flow inducer assembly 300 viewing in a different perspective view direction is also illustrated in FIG. 6, As shown in FIG. 6, the floor plate 320 is laterally extended out the outer side wall 340. The floor plate 320 is also laterally extended out the inner side wall 330 and attached to the lower seal plate wall 240. The configuration of the flow inducer assembly 300 as shown in FIG. 6 may improve mechanical properties of the flow inducer assembly 300, such as increasing mechanical strength, reducing vibration, etc.

Dimensions of the flow inducer assembly 300 may be designed to achieve cooling requirement for sufficiently cooling the turbine blades 140. Dimensions of the flow inducer assembly 300 may include radial heights of the inner side wall 330 and the outer side wall 340, circumferential distance between the inner side wall 330 and the outer side wall 340, orientation of the inlet 350 with respect to rotation direction R of the rotor disk 120, etc. The radial heights of the inner side wall 330 and the outer side wall 340 may be defined by a radial distance between the floor plate 320 and the seal arm 230. The floor plate 320 may be attached to the lower seal plate wall 240 at a radial location of the lowest radial point of the aperture 242, as illustrated in FIGS. 4-6. It is understood that the floor plate 320 may be attached to the lower seal plate wall 240 at a radial location below the lowest radial point of the aperture 242. The inner side wall 330 and the outer side wall 340 may be located at upstream and downstream edges of the aperture 242, or further away from the upstream and downstream edges of the aperture 242. Orientation of the inlet 350 may be perpendicularly to the rotation direction R which may drive more cooling air into the flow inducer assembly 300 in comparison with the orientation of the inlet 350 with an angle that is less than or greater than 90° with respect to the rotation direction R.

Figure 7:
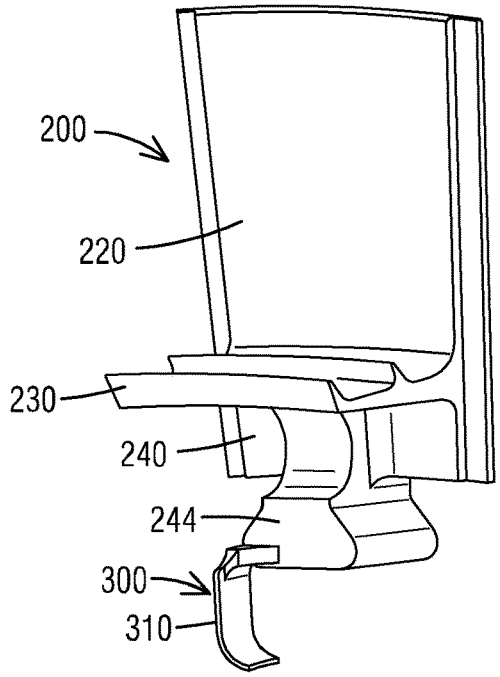

FIG. 7 illustrates a schematic perspective view of a seal plate 200 having an integrated flow inducer assembly 300 according to an embodiment of the present invention. As shown in FIG. 7, a root 244 is attached to the lower seal plate wall 240 and extends radially downward. The root 244 may have a dovetail shape. A flow inducer assembly 300 is integrated to the root 244 at a side facing away from the rotor disk 120 and extends outward in an axial direction. The flow inducer assembly 300 may include a curved plate 310. The curved plate 310 may have a scoop shape. The curved plate 310 may have a similar configuration as illustrated in FIGS. 2-3, which is not described in detail herewith.

Figure 8:
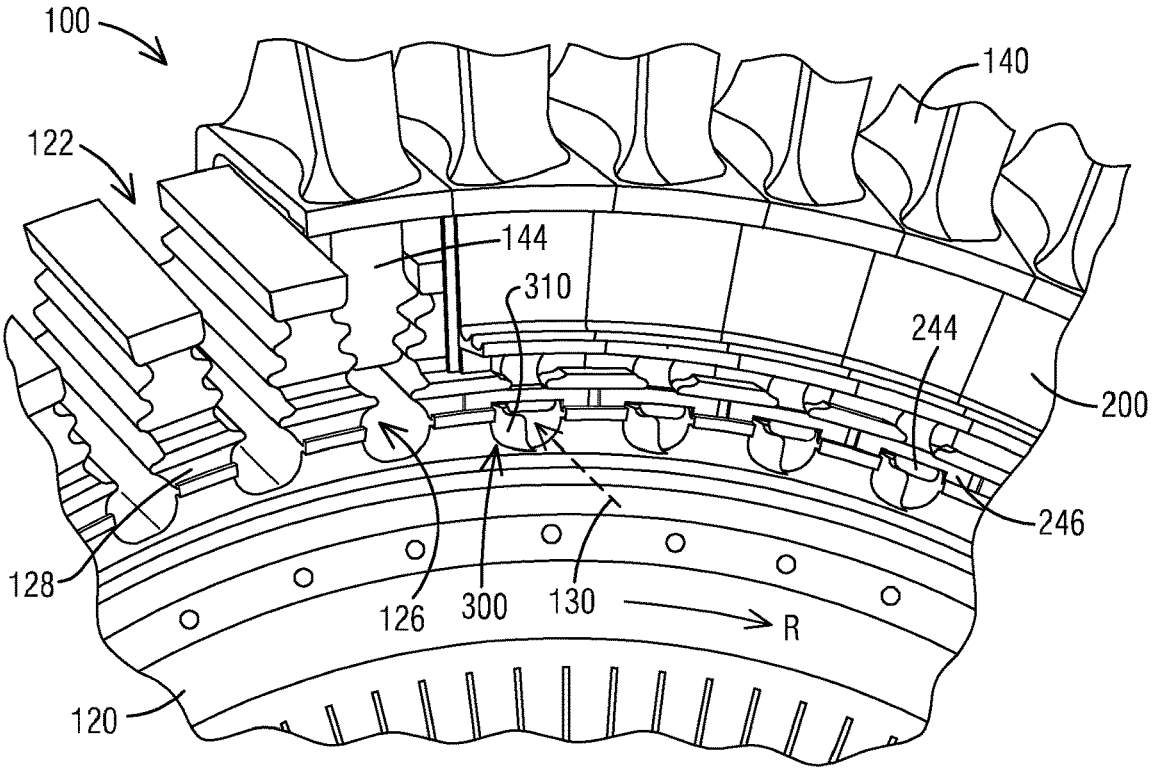
FIG. 8 illustrates a schematic perspective view of a portion of a gas turbine engine showing the last stage, in which an embodiment of the present invention shown in FIG. 7 is incorporated.
Figure 9:
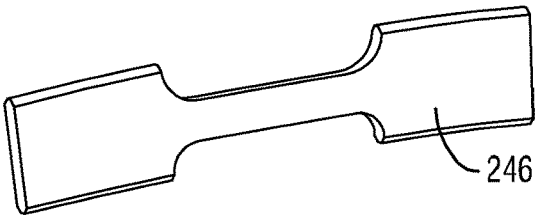
FIG. 9 illustrates a schematic perspective view of a locking plate which is shown in FIG. 8.

FIG. 8 illustrates a schematic perspective view of a portion of a gas turbine engine 100 showing the last stage looking in an aft side with respect to an axial flow direction, in which an embodiment of the present invention shown in FIG. 7 is incorporated. For clarity purpose, one turbine blade 140 and one seal plate 200 are removed from the rotor disk 120. As shown in FIG. 8, the seal plate 200 is attached to the rotor disk 120. The root 244 is displaced into the disk groove 122. The curved plate 310 is radially along the disk cavity 126 at a downstream side with respect to the rotation direction R of the rotor disk 120 after assembly. During operation of the gas turbine engine 100, rotation of the rotor disk 120 and the seal plate 200 therewith makes the curved plate 310 of the flow inducer assembly 300 function as a paddle that further induces cooling air 130, such as ambient air, in addition to cooling air 130 that is induced by a centrifugal force caused by rotation of the turbine blades 140, into the disk cavity 126 and enters insides of the turbine blades 140 from the blade roots 144 for cooling the turbine blades 140. A locking plate 246 may be inserted into a disk slot 128 for securing the seal plate 200 to the rotor disk 120. FIG. 9 illustrates a schematic perspective view of a locking plate 246.

According to an aspect, the proposed flow inducer assembly 300 may enable using ambient air as cooling fluid 130 for sufficiently cooling the last stage of turbine blades 140 of a gas turbine engine 100. During operation of the gas turbine engine 100, rotation of the rotor disk 120 and the seal plate 200 therewith makes the flow inducer assembly 300 function as a paddle that drives sufficient amount of ambient air from outside of the gas turbine engine 100 as the cooling air 130 into disk cavities 126 of rotor disk 120 and enters insides of the turbine blades 140 from the blade roots 144 for cooling the turbine blades 140. The proposed flow inducer assembly 300 eliminates bleeding compressor air for cooling the last stage of turbine blades 140, which increases turbine engine efficiency.

According to an aspect, the proposed flow inducer assembly 300 may be manufactured as an integrated piece of the seal plate 200. The seal plate 200 and the integrated flow inducer assembly 300 provide a lightweight design for preventing hot gas coming into the rotor disk 120 and simultaneously driving enough ambient air for sufficiently cooling the last stage of turbine blades 140 to achieve required boundary condition. The seal plate 200 and the integrated flow inducer assembly 300 provide sufficient cooling of the last stage of the turbine blades 140 with minimal cost.

Although various embodiments that incorporate the teachings of the present invention have been shown and described in detail herein, those skilled in the art can readily devise many other varied embodiments that still incorporate these teachings. The invention is not limited in its application to the exemplary embodiment details of construction and the arrangement of components set forth in the description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

REFERENCE LIST

100: Gas Turbine Engine
120: Rotor Disk
122: Disk Groove
124: Blade Mounting Section
126: Disk Cavity
128: Disk Slot
130: Cooling Flow
140: Turbine Blade
142: Blade Platform
144: Blade Root
200: Seal Plate
202: Seal Plate Hook
204: Seal Plate Protrusion
220: Upper Seal Plate Wall
230: Seal Arm
240: Lower Seal Plate Wall
242: Aperture on Lower Seal Plate Wall
244: Seal Plate Root
246: Locking Plate
300: Flow Inducer Assembly
310: Curved Plate having Scoop Shape
320: Floor Plate
330: Inner Side Wall
340: Outer Side Wall
342: Vertical Wall
350: Cooling Fluid Inlet

What is claimed is:

1. A gas turbine engine comprising:

a rotor disk comprising a disk groove, wherein the disk groove comprises a blade mounting section and a disk cavity;

a turbine blade, wherein the turbine blade comprises a blade root that is inserted into the blade mounting section of the disk groove;

a seal plate positioned on an aft side of the rotor disk with respect to an axial flow direction, wherein the seal plate comprises an upper seal plate wall and a lower seal plate wall, wherein the upper seal plate wall is configured to cover the blade root; and a flow inducer assembly positioned on the aft side of the rotor disk with respect to the axial flow direction, wherein the flow inducer assembly is integrated to the seal plate at a side facing away from the rotor disk, wherein the flow inducer assembly aligns with the disk cavity in a radial direction, wherein the disk cavity is an empty space between a radially inner surface of the blade root and the disk groove, wherein the lower seal plate wall comprises an aperture that is configured to align with the disk cavity, wherein the flow inducer assembly comprises a curved plate that is integrated to the lower seal plate wall and axially extends out from the lower seal plate wall perpendicularly, wherein the curved plate is positioned radially along a perimeter of the aperture at a downstream side with respect to a rotation direction of the rotor disk, and wherein the flow inducer assembly is configured to function as a paddle due to rotation of the rotor disk and the seal plate therewith during operation of the gas turbine engine to induce a cooling fluid into the disk cavity and enter inside of the turbine blade from the blade root for cooling the turbine blade.

2. The gas turbine engine as claimed in claim 1, wherein the curved plate comprises a scoop shape.

3. The gas turbine engine as claimed in claim 1, wherein a source of the cooling fluid comprises ambient air.

4. The gas turbine engine as claimed in claim 1, wherein an axial length of the curved plate changes along the radial direction.

5. A gas turbine engine comprising:

a rotor disk comprising a disk groove, wherein the disk groove comprises a blade mounting section and a disk cavity;

a turbine blade, wherein the turbine blade comprises a blade root that is inserted into the blade mounting section of the disk groove;

a seal plate positioned on an aft side of the rotor disk with respect to an axial flow direction, wherein the seal plate comprises an upper seal plate wall and a lower seal plate wall, wherein the upper seal plate wall is configured to cover the blade root; and a flow inducer assembly positioned on the aft side of the rotor disk with respect to the axial flow direction, wherein the flow inducer assembly is integrated to the seal plate at a side facing away from the rotor disk, wherein the flow inducer assembly is configured to function as a paddle due to rotation of the rotor disk and the seal plate therewith during operation of the gas turbine engine to induce a cooling fluid into the disk cavity and enter inside of the turbine blade from the blade root for cooling the turbine blade, wherein the lower seal plate wall comprises an aperture that is configured to align with the disk cavity, wherein the flow inducer assembly comprises a floor plate that axially extends out from the lower seal plate wall at a radial location that is the lowest radial point of the aperture, wherein the flow inducer assembly comprises an inner side wall and an outer side wall that are radially integrated along a perimeter of the aperture at an upstream side and along a perimeter of the aperture at a downstream side respectively with respect to a rotation direction of the rotor disk, and wherein the inner side wall and the outer side wall radially extend upward from the floor plate.

6. The gas turbine engine as claimed in claim 5, wherein the inner side wall comprises a curved plate and the outer side wall comprises a curved plate, and wherein the curved inner side wall and the curved outer side wall are configured to form a cooling fluid inlet facing to the rotation direction of the rotor disk.

7. The gas turbine engine as claimed in claim 5, wherein an arc length of the outer side wall is longer than an arc length of the inner side wall.

8. A gas turbine engine comprising:

a rotor disk comprising a disk groove, wherein the disk groove comprises a blade mounting section and a disk cavity;

a turbine blade, wherein the turbine blade comprises a blade root that is inserted into the blade mounting section of the disk groove;

a seal plate positioned on an aft side of the rotor disk with respect to an axial flow direction, wherein the seal plate comprises an upper seal plate wall and a lower seal plate wall, wherein the upper seal plate wall is configured to cover the blade root; and a flow inducer assembly positioned on the aft side of the rotor disk with respect to the axial flow direction, wherein the flow inducer assembly is integrated to the seal plate at a side facing away from the rotor disk, wherein the flow inducer assembly is configured to function as a paddle due to rotation of the rotor disk and the seal plate therewith during operation of the gas turbine engine to induce a cooling fluid into the disk cavity and enter inside of the turbine blade from the blade root for cooling the turbine blade, wherein the lower seal plate wall comprises a root extending radially downward, wherein the root is configured to be displaced into the disk groove after assembly, and wherein the flow inducer assembly axially extends out from the root.

9. The gas turbine engine as claimed in claim 8, wherein the flow inducer assembly comprises a curved plate, and wherein the curved plate is positioned radially along the disk cavity at a downstream side with respect to a rotation direction of the rotor disk after being attached to the rotor disk.

* * * * *